United States Patent [19]

Quester et al.

[11] 4,233,997

[45] Nov. 18, 1980

[54] RIB ROLLER FOR PROCESSING TOBACCO RIBS

[75] Inventors: Karl W. Quester; Josef Gontgen; Adolf Muller, all of Cologne, Fed. Rep. of Germany

[73] Assignee: Firm Wilh. Quester, Cologne, Fed. Rep. of Germany

[21] Appl. No.: 799,230

[22] Filed: May 23, 1977

[30] Foreign Application Priority Data

May 28, 1976 [DE] Fed. Rep. of Germany ..... 2623825

[51] Int. Cl.[3] ..... A24M 5/14

[52] U.S. Cl. ..... 131/147 R; 100/155 R; 493/467; 100/168; 100/169; 100/171

[58] Field of Search ..... 131/147 R, 120, 147 A, 131/121, 148, 123, 149, 139; 270/68 A; 100/155, 168, 169, 171

[56] References Cited

U.S. PATENT DOCUMENTS

| | | | |
|---|---|---|---|
| 1,447,075 | 2/1923 | Gutman | 131/147 R |
| 3,328,026 | 6/1967 | Bartizal | 270/68 A |
| 4,032,133 | 6/1977 | Steffens et al. | 270/68 A |

*Primary Examiner*—V. Millin

*Attorney, Agent, or Firm*—Diller, Ramik & Wight

[57] ABSTRACT

This disclosure relates to a rib-rolling mechanism for processing tobacco ribs and includes a pair of relatively rotatable rollers having peripheral surfaces defining therebetween a throat through which it is adapted to pass tobacco, the rollers having shafts, the shafts of the first of the rollers being journaled for rotation in fixed bearings and the shafts of the second of the rollers being journaled for rotation in movable bearings, a device for resiliently urging the second roller toward the first roller, the latter device including a rod connected to each of the movable bearings, a sleeve in external telescopic relationship to each of the rods, springs coupled between each of the sleeves and the second roller for urging the latter toward the first roller, and elements for axially shifting the rods to vary the force exerted by the springs in a direction to urge the second roller toward the first roller.

25 Claims, 2 Drawing Figures

RIB ROLLER FOR PROCESSING TOBACCO RIBS

This invention relates to a rib-rolling mechanism for processing tobacco ribs which includes a first roller mounted for rotation in fixed bearings relative to a machine frame and a second or setting roller mounted for rotation in bearings movable relative to the machine frame for adjusting an aperture or throat between peripheral surfaces of the rollers.

Conventional rib-rolling mechanisms are known for rolling ribs of tobacco leaves, and in such known mechanisms a pre-set aperture or throat is set between opposing peripheral surfaces of rollers with the size of the throat depending upon the type of tobacco and the tobacco ribs which are being processed. None of the rollers is movably mounted so that the rollers cannot be moved toward or away from each other depending upon the material to be rolled. The rollers have shafts journaled for rotation in bearings and one of the rollers is provided with a cutting stamp which presses against a stationary mounted bursting plate. If the pressure in the throat or aperture between the peripheral surfaces of the rollers exceeds an acceptable limit which may occur, for example, when a large foreign body passes between the rollers, the bursting plate breaks, the throat or aperture between the rollers correspondingly opens or widens, and the machine must then be stopped so that the correct roller aperture or throat may be reset by inserting another bursting plate.

Such rib-rolling mechanisms must obviously take into account frequent stoppages caused by breakage of the bursting plates which is highly undesirable since downtime represents corresponding manufacturing expense. A further disadvantage of such conventional mechanisms is that the roller aperture or throat cannot be accurately reproduced in a repetitive fashion because deformations occur at the bursting plate due to chronological alterations.

In the field of cold and hot rolling mechanisms which may be used for rolling sheet metal and the like it is known to pre-tension a movable roller by means of a spindle and a tension device against a sprung suspension system with the pre-tensioning device being movable along with an adjustable roller relative to a fixed roller. In such cases the mechanisms are generally so designed that one adjusting device is mounted on one crosspiece of a roller frame and is located at a relatively great distance from another of the adjusting devices. The adjusting devices of such mechanisms are thus generally located between roller pillars or the like and a restricted space is provided for manipulating the same. This leads to a situation in which the manual control for adjustment which is generally accomplished through hand wheels is located in a plane transverse to the pillars of the rolling mechanisms so that a worm drive is necessary for transmitting movement from the manual control (handwheel) to an associated spindle or the like coupled to the adjusting device. Thus, such adjusting devices are relatively cumbersome, difficult to adjust, expensive to install and repair, etc. In keeping with the foregoing it is a primary object of this invention to provide a novel rib-rolling mechanism which is relatively simple in construction, easily installed and repaired, easily supervised, and operated without hindrance. The invention is particularly characterized in that an adjusting roller is pre-tensioned by means of a spindle in the form of a tie rod coupled to movable bearings journaling one of the rollers, a sleeve in external telescopic relationship to each of the tie rods, each sleeve being threaded in a frame of the rib-rolling mechanism, and each of the sleeves being rotatable by means of a handwheel to increase or decrease the force of springs which pre-tension the roller carried by the movable bearings.

In keeping with another object of this invention, the rib-rolling mechanism further includes a threaded end portion associated with each tie rod to which is threadably secured a nut for increasing or decreasing the tension of springs associated with the tie rod.

A further object of this invention is to provide a novel rib-rolling mechanism of the type aforesaid wherein each sleeve is provided at opposite axial ends with thrust bearings which bear against associated springs at one end and a loading nut at an opposite end for readily increasing or decreasing the tension on the movable or adjusting roller, and moreover, by virtue of the fact that the sleeves are in external telescopic relationship to the tie rods the overall length of the adjusting device is considerably shorter than in known mechanisms, no transverse carriers are necessary, and the adjusting device lies free and unobstructed relative to portions of the machine frame so that manual control may be rapidly and readily effected.

In further keeping with this invention, at least one tie rod associated with each movable or adjusting roller carries a disk which is associated with a scale such that upon axial movement imparted to the tie rod an indication between the disk and scale is indicative of the rotary angular position of the tension device whereby the tensioning can be exactly set and reproduced repetitively.

IN THE DRAWING

Figure 2:
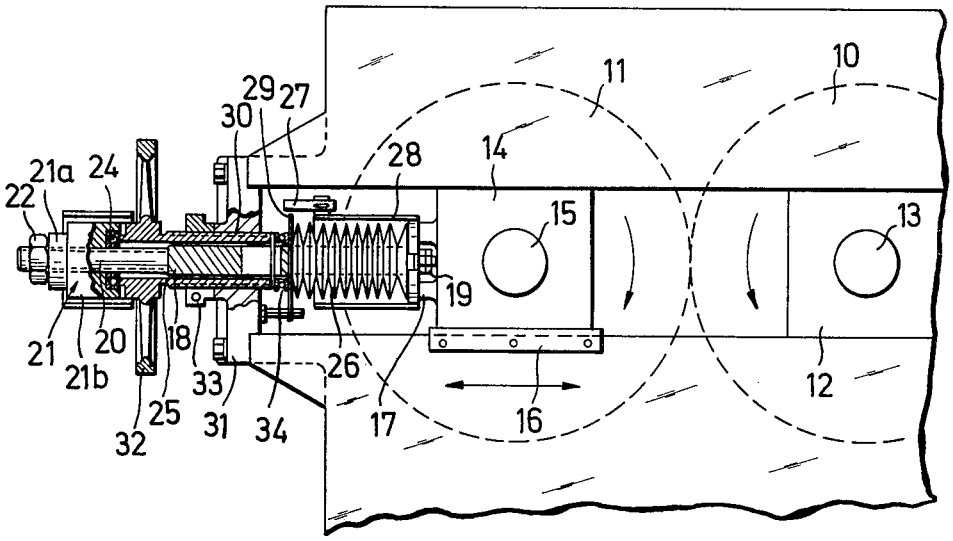
FIG. 2 is a fragmentary front elevational view of the mechanism shown in FIG. 1 taken generally along line II—II of FIG. 1, and illustrates details of the mechanism.
Figure 1:
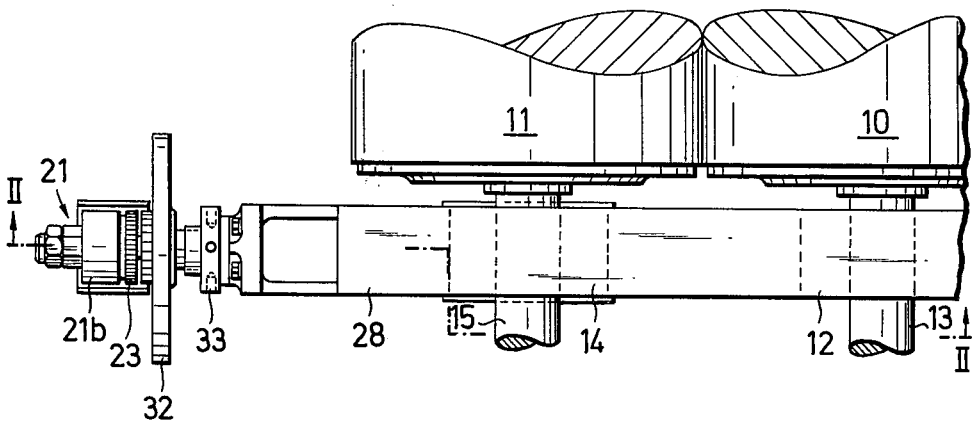
FIG. 1 is a top plan view of one side of a machine having a rib-rolling mechanism constructed in accordance with this invention, and illustrates a pair of rollers whose shafts are carried by fixed and movable bearings, and a tensioning device is coupled to the movable bearing.

A rib-rolling mechanism is fully illustrated in FIGS. 1 and 2 and includes a fixed roller 10 and an adjusting or movable roller 11 each having peripheral surfaces (unnumbered) which define therebetween a gap or throat through which is adapted to pass tobacco. The fixed roller 10 includes a shaft 13 journaled for rotation in a fixed bearing 12 at one side of the machine and a like arrangement (not shown) is at the opposite side of the machine. The roller 11 includes a shaft 15 which is journaled for rotation in a movable bearing 14 and the like arrangement (not shown) exists at the opposite side of the machine. The bearing 14 is reciprocated in the manner indicated by the double-headed arrow in FIG. 2 and is guided in such reciprocal motion by a conventional guide plate 16.

Both rollers 10 and 11 are driven by conventional drive belts or gear wheels (not shown).

The bearing 14 of the movable or adjusting roller 11 has fixed thereto a generally U-shaped bracket 17 having a base plate (unnumbered) containing a hole through which passes a tie rod 18. Within the interior of the U-shaped bracket 17 are two nuts 19 that are connected to a threaded end (unnumbered) of the tie rod 18 to rigidly connect the tie rod 18 to the bearing 14.

At an axially opposite end the tie rod 18 includes a threaded portion 20 to which is screw-threaded a fine adjustment nut 21 which may be locked in position by a locknut 22. The fine adjustment nut 21 consists of a threaded portion 21*a* and a sleeve portion 21*b*. The sleeve portion 21*b* faces the adjusting roller 11 and carries along its outer cylindrical surface a scale 23 (FIG. 1) from which the rotary angular position of the nut 21 can be read in order to determine the amount of fine adjustment of the biasing means or springs 26. The fine adjusting nut 21 bears against a thrust washer or bearing 24 which bears against an end face (unnumbered) of a threaded sleeve 25 having its opposite end another thrust bearing 34 which bears against an indicator disk 29. The indicator disk 29 presses against a plurality of springs or belville washers 26 which surround the tie rod 18. The springs 26 can be compressed and the compression thereof depends upon how tightly the nut 21*a* is screwed upon the threaded portion 20 of the tie rod 18.

An indication of the spring force applied is provided by a measurement scale 27 on a protective tube 28 surrounding the springs 26 and being attached to the bracket 17. The scale 27 is therefore rigidly connected to the bearing 14. The indicator consists of a disk 29 fixed between the springs 26 and the axial bearing 34 and the position of the indicator shows the degree of compression of the springs 26. A pin (unnumbered) passes through a radial bore of the tie rod 18 and the ends thereof are received in longitudinal slots or grooves of the sleeve 25 which permits axial relative motion between the tie rod 18 and the sleeve 25 while precluding relative rotational movement therebetween.

The entire unit consisting of the bearing 14 and the tie rod 18 with all the components attached thereto can be moved by rotation of the threaded sleeve 25 which is threaded into a threaded bore 30 of a casing 31 fixed to the frame (unnumbered) of the machine. For this purpose the threaded sleeve 25 has fixed thereto a handwheel 32 which may be used to rotate the sleeve once a locknut 33 has been loosened.

In a practical embodiment of the rib-rolling mechanism the springs 26 depending upon their adjustment exert a pre-tension of up to 14,000 kp. The tolerance through which the adjusting roller 11 can deviate as a maximum is 15 mm.

In order to adjust the adjusting roller 11 relative to the fixed roller 10 and thus the throat or gap therebetween the nut 33 is loosened in order to rotate the handwheel 32 to adjust the threaded sleeve 25 relative to the casing 31 and thus move the roller 11 relative to the roller 10. The handwheel 32 is so rotated that the adjusting roller 11 is pressed firmly against the fixed roller 10.

Once the adjusting roller 11 is pressed against the fixed roller 10 by rotation of the handwheel 32 the spring group 26 is pre-tensioned by rotating the nut 21 in a direction which retracts the roller 11 away from the roller 10. The spring tension during this tensioning operation can be read from the scale 27. Thereafter the locknut 33 is loosened and the handwheel 32 is rotated to advance the adjusting roller 11 against the fixed roller 10 after which the locknut 33 is retightened. If additional adjusting of the throat or gap is desired, the nut 21 can be additionally tightened to increase the tension of the springs 26. This alteration in tension occurs within relatively narrow limits and thus is of secondary importance. However, through both of the adjustments heretofore noted by virtue of the sleeve 25 and the nut 21 the throat or aperture between the rollers 10, 11 can be reproduced and/or retained with great accuracy.

What is claimed is:

1. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship of each of said rods, spring biasing means coupled between each of said sleeves and said second roller for urging the latter toward said first roller, means for axially shifting said rods to vary the force exerted by said springs in a direction to urge said second roller toward said first roller, means for bodily moving as a unit said second roller, spring biasing means, rods and sleeves; and said bodily moving means including means for effecting rotation of said sleeves without affecting the force of said springs as established by said axially shifting means.

2. The rib-rolling mechanism as defined in claim 1 including means threadably secured to each of said rods at ends of the latter remote from said urging means for axially moving each rod relative to its associated sleeve.

3. The rib-rolling mechanism as defined in claim 1 including means for indicating the force applied by said springs upon said second roller.

4. The rib-rolling mechanism as defined in claim 1 including means associated with one of said rods and sleeves for indicating the force applied by said springs upon said second roller.

5. The rib-rolling mechanism as defined in claim 1 including means for indicating the angular relationship of said axial shifting means relative to said sleeves.

6. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, and means for axially adjusting the position of each of said sleeves relative to said second roller.

7. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, a frame, and means for threadably securing each of said sleeves to said frame for axial adjusting movement toward and away from said second roller.

8. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, thrust bearings disposed at opposite ends of each of said sleeves, and one of said thrust bearings is positioned between each of said sleeves and its associated spring biasing means.

9. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable berings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, each sleeve has a threaded end portion remote from said spring biasing means, and said axial shifting means in a nut threaded upon each of said threaded end portions.

10. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, a frame housing said bearings, means threadably securing each sleeve to said frame, a thrust bearing at opposite ends of each of said sleeves, one of said thrust bearings being disposed between an associated sleeve and its spring biasing means, a second of said thrust bearings being disposed between an associated sleeve and its axial shifting means, and said latter means being a nut threaded upon a threaded end portion of its associated rod.

11. The rib-rolling mechanism as defined in claim 10 including means for indicating the force applied by said springs upon said second roller.

12. The rib-rolling mechanism as defined in claim 11 including means for indicating the angular relationship of said axial shifting means relative to said sleeves.

13. The rib-rolling mechanism as defined in claim 10 including means associated with one of said rods and sleeves for indicating the force applied by said springs upon said second roller.

14. The rib-rolling mechanism as defined in claim 13 including means for indicating the angular relationship of said axial shifting means relative to said sleeves.

15. The rib-rolling mechanism as defined in claim 10 including means for indicating the angular relationship of said axial shifting means relative to said sleeves.

16. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, a casing, means for bodily moving as a unit said second roller, spring biasing means, rods and sleeves, said last-mentioned means being a threaded connection between said casing and sleeves.

17. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, a casing, and means for variably adjusting said sleeves relative to said casing to move said second roller relative to said first roller.

18. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, a casing, means for axially adjusting the position of each of said sleeves relative to said second roller, said last-mentioned means being a threaded connection between said sleeve and said casing, and a lock nut carried by each of said sleeves for precluding motion of said sleeves in at least one direction relative to said casing.

19. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, axial bearing means disposed between each of said sleeves and said biasing means.

20. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, axial bearing means disposed between each of said sleeves and said biasing means, a disk disposed between said anti-friction bearing means and said biasing means, and said disk in part defining means for indicating the biasing force of said biasing means.

21. A rib-rolling mechanism for processing tobacco ribs comprising a pair of relatively rotatable rollers having peripheral surfaces defining therebetween a throat through which is adapted to pass tobacco, said rollers having shafts, the shaft of a first of said rollers being journaled for rotation in fixed bearings, the shaft of a second of said rollers being journaled for rotation in movable bearings, means for resiliently urging said second roller toward said first roller, said urging means including a rod connected to each of said movable bearings, a sleeve in external telescopic relationship to each of said rods, spring biasing means coupled between each of said sleeves and said second roller for urging the latter toward said first roller, means for axially shifting said rods to vary the force exerted by said springs in a direction to urge said second roller toward said first roller, axial bearing means disposed between each of said sleeves and said biasing means, a disk disposed between said anti-friction bearing means and said biasing means, said disk in part defining means for indicating the biasing force of said biasing means, and said indicating means further including means movable with said movable bearings and cooperative with said disk for indicating the biasing force of said biasing means.

22. The rib-rolling mechanism as defined in claim 1 including means for axially adjusting the position of each of said sleeves relative to said second roller.

23. The rib-rolling mechanism as defined in claim 1 including a frame, and means for threadably securing each of said sleeves to said frame for axial adjusting movement toward and away from said second roller.

24. The rib-rolling mechanism as defined in claim 1 including thrust bearings disposed at opposite ends of each of said sleeves, and one of said thrust bearings is positioned between each of said sleeves and its associated spring biasing means.

25. The rib-rolling mechanism as defined in claim 1 wherein each sleeve has a threaded end portion remote from said spring biasing means, and said axial shifting means is a nut threaded upon each of said threaded end portions.

* * * * *